US005721551A

United States Patent [19]

Tran et al.

[11] Patent Number: 5,721,551

[45] Date of Patent: Feb. 24, 1998

[54] APPARATUS FOR ATTENUATING TRAVELING WAVE REFLECTIONS FROM SURFACES

[75] Inventors: Hung Ban Tran, Orange; Dennis M. Rubien, Redondo Beach; Pravit Tulyathan, Torrance, all of Calif.

[73] Assignee: Boeing North American, Inc., Seal Beach, Calif.

[21] Appl. No.: 636,009

[22] Filed: Apr. 22, 1996

[51] Int. Cl.[6] ..... H01Q 17/00

[52] U.S. Cl. ..... 342/1; 342/2; 342/4

[58] Field of Search ..... 342/1, 2, 3, 4

[56] References Cited

U.S. PATENT DOCUMENTS

| | | | |
|---|---|---|---|
| 3,633,206 | 1/1972 | McMillan | 343/754 |
| 3,721,982 | 3/1973 | Wesch | 342/1 |
| 4,003,840 | 1/1977 | Ishino et al. | 342/1 X |
| 4,084,161 | 4/1978 | Manning et al. | 342/2 |
| 4,162,496 | 7/1979 | Downen et al. | 342/4 |
| 4,825,221 | 4/1989 | Suzuki et al. | 342/785 |
| 4,888,590 | 12/1989 | Chase | 342/3 |
| 4,965,869 | 10/1990 | Fortney | 343/781 R |
| 5,095,311 | 3/1992 | Sajiki et al. | 342/1 |
| 5,125,992 | 6/1992 | Hubbard et al. | 156/151 |
| 5,202,688 | 4/1993 | Hubbard et al. | 342/1 |
| 5,381,149 | 1/1995 | Dougherty et al. | 342/1 |
| 5,384,571 | 1/1995 | Myers et al. | 342/4 |
| 5,385,623 | 1/1995 | Diaz | 156/197 |
| 5,561,428 | 10/1996 | Czaja et al. | 342/1 |
| 5,576,710 | 11/1996 | Broderick et al. | 342/1 |

*Primary Examiner*—John B. Sotomayor

*Attorney, Agent, or Firm*—Lawrence N. Ginsberg; Charles T. Silberberg

[57] ABSTRACT

An apparatus for attenuating traveling wave reflections from a surface, due to an impedance mismatch between the surface and free space. The apparatus includes a resistive element having an impedance between that of the surface and free space. The resistive element is positionable relative to the surface so as to minimize the impedance mismatch between the surface and free space. The resistive element is preferably a resistively graded element, which includes a forward end with an impedance approaching the impedance of the surface. An aft end of the resistively graded element has a high impedance relative to free space. The aft end is positionable sufficiently distant from the surface so as to minimize any traveling wave reflection due to impedance mismatch between the surface and free space.

14 Claims, 8 Drawing Sheets

APPARATUS FOR ATTENUATING TRAVELING WAVE REFLECTIONS FROM SURFACES

BACKGROUND OF THE INVENTION

1. Field of the Invention

The present invention relates to the attenuation of traveling wave reflections from surfaces and more particularly to the use of a resistive element for minimizing an impedance mismatch between a surface and free space.

2. Description of the Related Art

Electromagnetic energy radiating in the presence of an obstacle (conducting and/or material body) induces currents on the obstacle. These currents produce the scattered electromagnetic field. In the book entitled "Time-Harmonic Electromagnetic Fields," authored by R. F. Harrington, 1961, the radar cross section (RCS) of an obstacle is defined as "the area for which the incident wave contains sufficient power to produce, by omni-directional radiation, the same back-scattered power density." RCS due to a surface traveling wave is significant when a long smooth object is illuminated by electromagnetic energy at relatively low angles of incidence (near grazing angle). The traveling wave is launched only if there is a component of the incident electric field tangential to the surface and in the plane of incidence. The RCS pattern of a long thin structure is discussed in the book entitled "Radar Cross Section," authored by E. F. Knot et at, 1985, pages 147–150 which references the article entitled, "End Fire Echo Area of Long, Thin Bodies," IRE Trans. Antennas Propag., Vol. AP-6, No. 1, Jan. 1958, pages 133–139 authored by L. Peters, Jr. In this article, a long thin structure is approximated by a thin wire.

Referring now to the figures, FIG. 1 is reproduction of FIG. 5–12 from the book entitled "Radar Cross Section", with numeral designations added for clarity. The scattering 8 from a thin wire 10 excited by a plane wave 12 is shown in this figure. There exists two current waves, one traveling in the forward direction and one in the backward direction (14 and 16, respectively). The backward traveling current wave 16 will give rise to the same kind of RCS pattern generated by the forward current wave 14, but its location in space will be in the opposite direction. Due to the impedance mismatch at the ends of the wire 10 and the finite conductivity at the wire surface, the level of the scattering in the backward direction will be less than that in the forward direction.

The backscattered RCS from the backward current wave in a long, smooth metallic surface is the quantity of interest since the energy is directed back to the radar antenna for the detection of the target. Although the above thin wire analogy assumes a long slender scatterer, the surface wave phenomenon occurs in other structures such as airfoils and missile bodies. In fact, any discontinuity due to the termination of a finite structure or surface discontinuity of a subsection of a larger surface due to seams and gaps can cause this type of scattering.

The maximum RCS of the surface traveling wave for a long slender body is located at the angle approximated by:

$$\theta = 49.35 * \sqrt{\frac{\lambda}{b}} \quad (1)$$

where θ is the angle (in degrees) from the long axis of the structure, λ, is the wavelength of the electromagnetic wave, and b is the length of the body. This location of the first surface traveling wave lobe is important since it has the highest level of backscatter to the radar receiver.

The suppression of the traveling wave scattering is typically provided by bonding MAGnetic Radar Absorbing Material (MAG RAM) to the electrically conductive part of the structure that supports the traveling wave. In the situation where the body has a metallic and/or dielectric internal structure with a dielectric surface, the surface has to be metalized (by applying conductive paint or metallic time spray) prior to the application of the MAG RAM. Determination of the effectiveness of the MAG RAM in suppressing the traveling wave is performed by measuring the RCS of a full scale model of the long thin target that supports the traveling wave. Full scale models are required for this type of measurement since the MAG RAM material is frequency sensitive. A low cost alternate to this measurement is the use of a ramp structure located in the quiet zone of a parallel plate set up as disclosed and claimed in U.S. Pat. No. 5,337,016 entitled "Method and Apparatus for Traveling Wave Attenuation Measurement," assigned to the present assignee.

MAG RAM is made of iron particles embedded in a polyurethane, flouropolymer, neoprene, or silicone binder. The effectiveness of the MAG RAM in absorbing the electromagnetic energy is dependent on the amount of the iron particles and the thickness of the MAG RAM application. Thicker application is required for lower frequencies. The weight of the iron which can be up to 88% of the total MAG RAM weight which is typically (0.18 lbs./cubic inch) limits its use in lower frequency range and where there are weight limitations.

SUMMARY OF THE INVENTION

The present invention is an apparatus for attenuating traveling wave reflections from a surface, due to an impedance mismatch between the surface and free space. In a broad aspect, the apparatus includes a resistive element having an impedance between that of the surface and free space. The resistive element is positionable relative to the surface so as to minimize the impedance mismatch between the surface and free space.

The resistive element is preferably a resistively graded element, which includes a forward end with an impedance approaching the impedance of the surface. An aft end of the resistively graded element has a high impedance relative to free space. The aft end is positionable sufficiently distant from the surface so as to minimize any traveling wave reflection due to impedance mismatch between the surface and free space.

The resistively graded element preferably has a tubular shape with a hollow interior.

The present invention can be made very inexpensively, it is lightweight, is extremely easy to install, and the RCS reduction is broadband.

Other objects, advantages and novel features of the present invention will become apparent from the following detailed description of the invention when considered in conjunction with the accompanying drawings.

BRIEF DESCRIPTION OF THE DRAWINGS

The same elements or parts throughout the figures are designated by the same reference characters.

DETAILED DESCRIPTION OF THE PREFERRED EMBODIMENT

Figure 1:
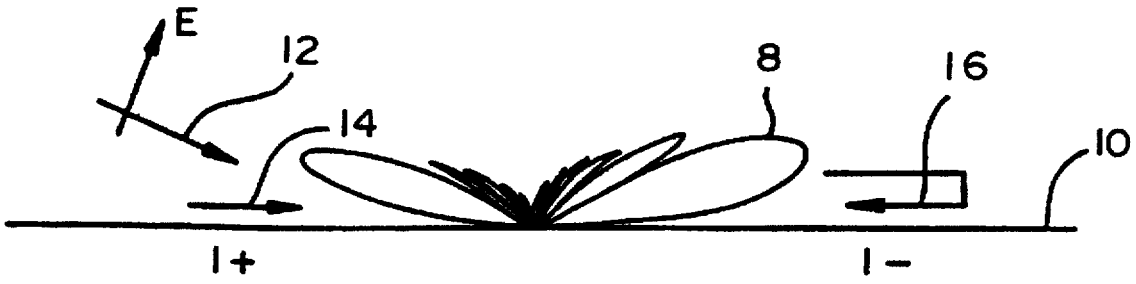
FIG. 1 (PRIOR ART)
FIG. 1 (Prior Art) illustrates the forward and backward surface traveling wave scattering for a long, thin wire.
Figure 2:
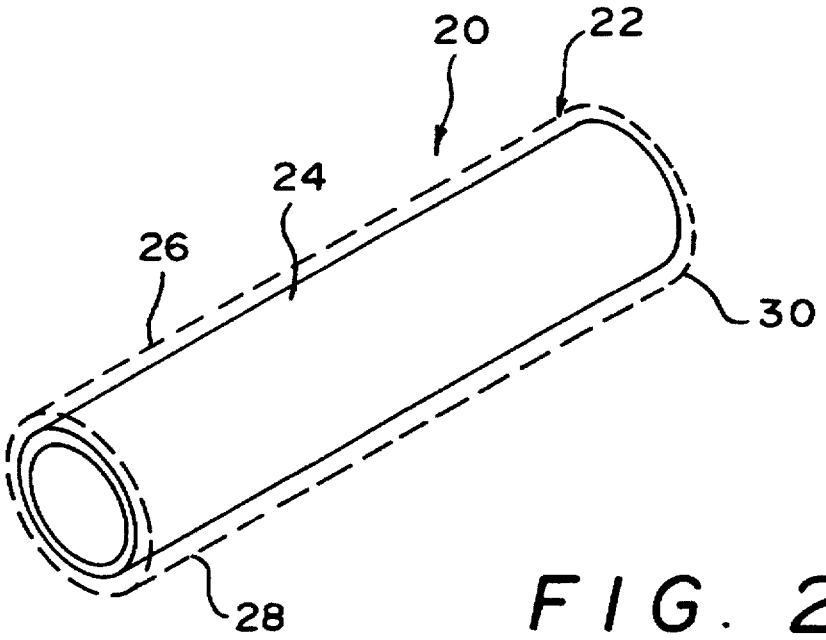
FIG. 2 is a perspective illustration of a resistive element of the apparatus of the present invention.
Figure 3:
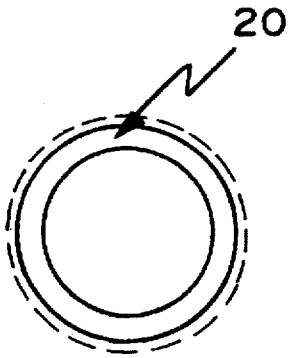
FIG. 3 is an end view of the resistive element of FIG. 2.
Figure 4:
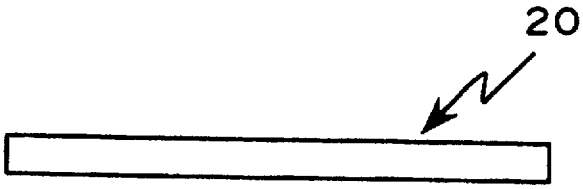
FIG. 4 is a side view of the resistive element of FIG. 2.

Referring, again now, to the figures of the drawings and the characters of reference marked thereon, FIGS. 2–4 illustrate a first embodiment of the apparatus of the present invention, designated generally as 20. The apparatus 20 includes a resistive element 22, which is positionable relative to a surface (not shown). The resistive element 22 has an impedance between that of the surface and free space. Thus, the impedance mismatch between the surface and free space is minimized. The resistive element may be formed of, for example, Kapton™ material, resin-impregnated fiberglass or resin-impregnated quartz fabric 24. The fiberglass or quartz fabric 24 has a conductive polymer coating 26 formed thereon. The surface resistivity can be varied by the amount of conductive polymer sprayed on the surface. The resistive element 22 is preferably shaped in the form of an elongated tubular member. The resistive element 22 is resistively graded, having a forward end 28 with an impedance approaching the impedance of a surface to which it becomes attached. An aft end 30 has a high impedance relative to free space due to the dielectric constant of the apparatus 20. The resistive element can be of uniform impedance or resistance. This will provide adequate traveling wave attenuation for applications where less than optimum attenuation is required.

Figure 5:
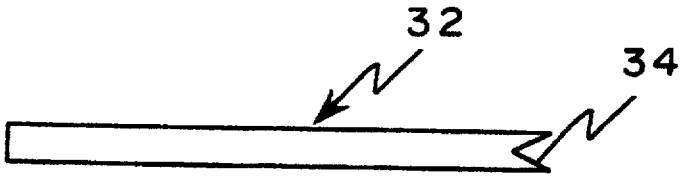
FIG. 5 is a side view of an alternate embodiment of the resistive element in which the aft end is shaped to further minimize impedance mismatch.

FIG. 5 illustrates an alternate embodiment of the present invention, designated generally as 32. In this embodiment 32, the aft end 34 is pointed so that it does not terminate in 90°. This feature further minimizes impedance mismatch.

Figure 6:
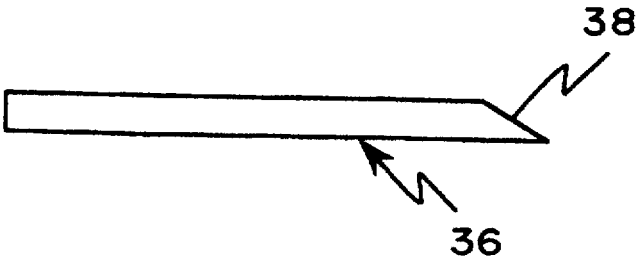
FIG. 6 is a side view of an another alternate embodiment which includes a wedged aft end for minimizing impedance mismatch.

Referring now to FIG. 6, another embodiment is shown, designated generally as 36 in which the aft end 38 is wedged, thereby providing another means for minimizing the impedance mismatch between the path of the surface traveling wave and free space.

Figure 7:
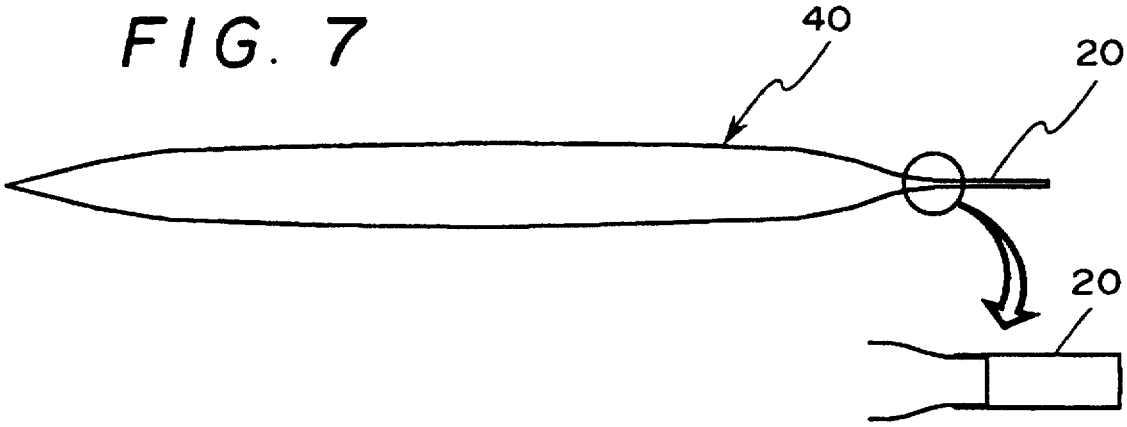
FIG. 7 is a schematic illustration of a scattering body having the apparatus of the present invention attached thereto.

FIG. 7 is a schematic illustration of a scattering body, designated generally as 40, onto which the apparatus 20 of the present invention is attached at an aft end thereof. The apparatus 20 may be connected by a number of different means to the body 40. For example, in the embodiment of FIG. 7, the aft end of body 40 is fitted within the hollow space in the tube 20. Adhesive bonding prevents relative displacement. Obviously, many types of attachment means may be provided, such as screw means or the use of locking mechanisms. The scattering body 40 may be, for example, a wing, the vertical or horizontal trailing edge of an aircraft, or of a spacecraft.

Figure 8:
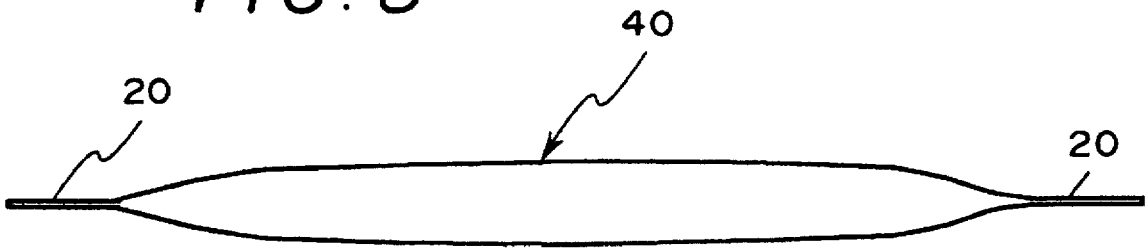
FIG. 8 is a schematic illustration of a scattering body having two resistive elements attached thereto, one at a forward end and another at an aft end.

FIG. 8 illustrates that the apparatus 20 of the present invention may be affixed to the forward end of a scattering body 40 and/or the aft end. A traveling wave propagates along the length of a body and is reflected upon reaching a terminal end of the body. If the apparatus 20 of the present invention is affixed to both ends of the body, the surface currents due to the traveling wave are further attenuated. However, in some situations, the apparatus 20 cannot be placed at the aft end of the body 40. In such situations, it may be placed solely at the forward end. In this instance it also serves to attenuate traveling wave reflections from the surface of the body.

Figure 9:
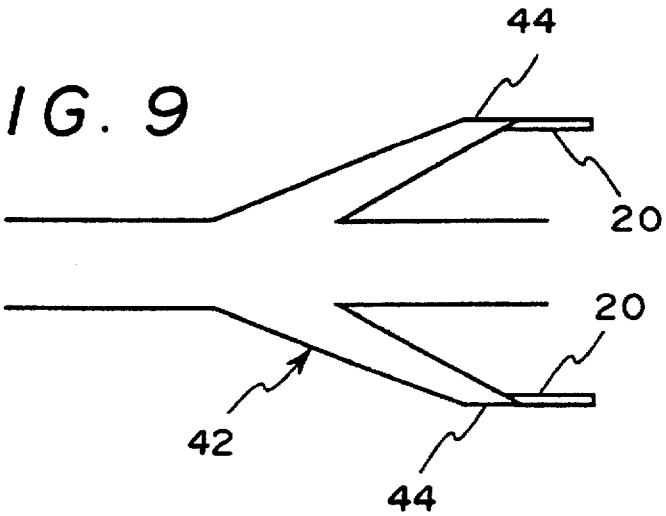
FIG. 9 is a schematic illustration of an airplane utilizing a pair of apparatus of the present invention on the wing tips.

Referring now to FIG. 9, an example of the utilization of the present invention on the wing and/or empennage of an airplane 42, is illustrated. The apparatus 20, in this instance, is affixed to the tips 44 of the aircraft 42. Typically, the surface current, which causes the traveling wave reflections, is concentrated on the tip 44. This current channeled along the apparatus 20 is eventually dissipated by its surface impedance matching characteristics.

Figure 10:
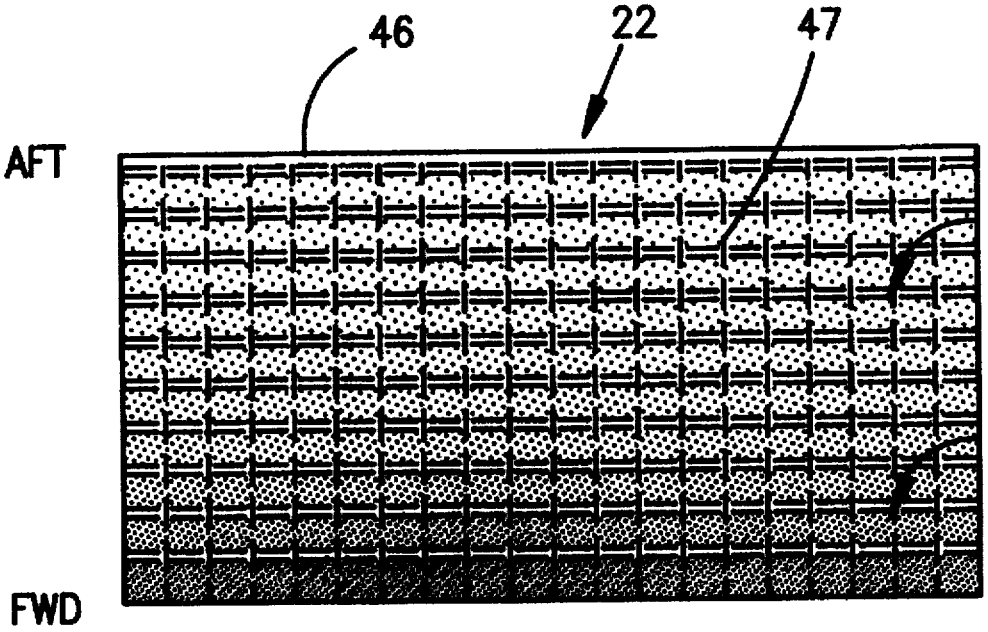
FIG. 10 shows an early step in the manufacture of the resistive element of the present invention using a fabric material with a resistive coating to form a tubular member.

Referring now to FIG. 10, one method of manufacture of the resistive element 22 is shown in its initial stages. A flat sheet of resin-impregnated fiberglass or quartz fabric 46 is provided. A portion of this sheet is shown in a greatly enlarged view. The non-uniformity of the weave is illustrated by strand line 47. A conductive polymer is sprayed on top of that flat sheet 46. The conductive polymer may be, for example, such as that described in U.S. Pat. No. 5,002,824, issued to L. F. Warren. The conductive polymer can be sprayed uniformly across the fabric or is preferably sprayed thicker at one end and tapered off so as to provide a gradient of resistive material. The resulting resistively graded element is then rolled upon a support tube to form a tubular member. It is noted that a single ply of this element is used to maintain the proper resistance grading. However, to provide sufficient structural integrity, a non-coated fabric of the same material is preferably formed underneath this single ply to provide this structural basis.

Figure 11:
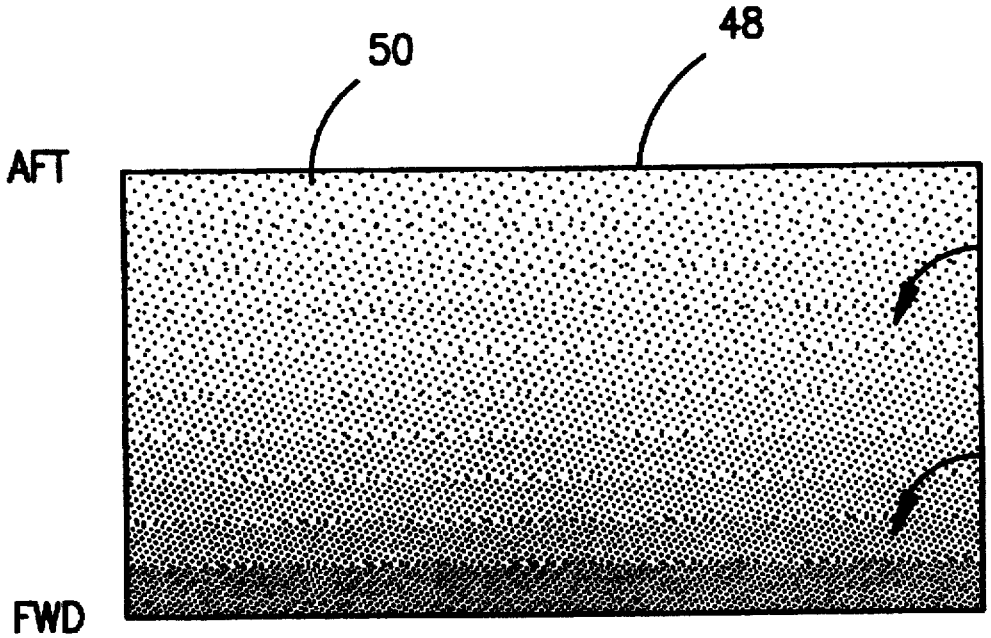
FIG. 11 shows an early step in the manufacture of the resistive element of the present invention using Kapton™ with a resistive coating to form a tubular member.

Referring to FIG. 11, when a Kapton™ resistive element is utilized, it is preferred that a structural tube formed of fabric be first fabricated. Then, a sheet of Kapton™ material is formed and sized to wrap around the structural base to form a single ply of Kapton™ material around the base member. This resistive element is then adhesively bonded to the structural part. The Kapton™ sheet 48 is preferably formed with resistively graded patterns 50. The resistive patterns are formed by first coating the Kapton™ with resistive material such as nichrome or nickel. A Kapton™ resistive element is preferred to fiberglass fabric due to its surface smoothness and accurate resistive gradient values. However, Kapton™ material does not readily conform to a doubly curved surface as fiberglass fabric.

Figure 12:
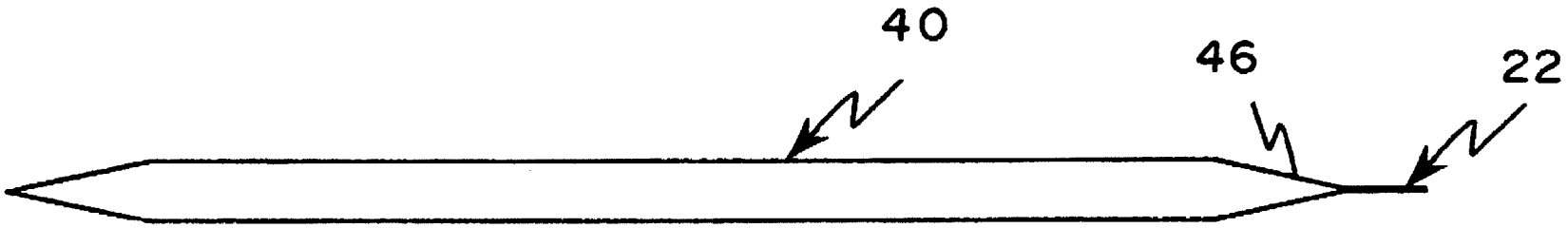
FIG. 12 illustrates an example of a scattering body with a resistive element of the present invention, illustrating the principles of the present invention.

An example of the implementation of the principles of the present invention is illustrated below:

Referring to FIG. 12, a scattering body 40 is shown, which has conical forward and aft ends. The cone length is 3 inches with a base diameter of 1 inch. The length of the cylindrical body 40 (not including the conical ends) is 23.5 inches. An elongated tubular element 22, with a diameter of 0.15 inch, is attached to the aft end 46 of the body 40. Certain assumptions are made relative to this example. Firstly, it is noted that the body 40 is a perfectly conducting body. Secondly, it is assumed that there is a perfect electrical connection between the element 22 and aft end 46.

Figure 13:
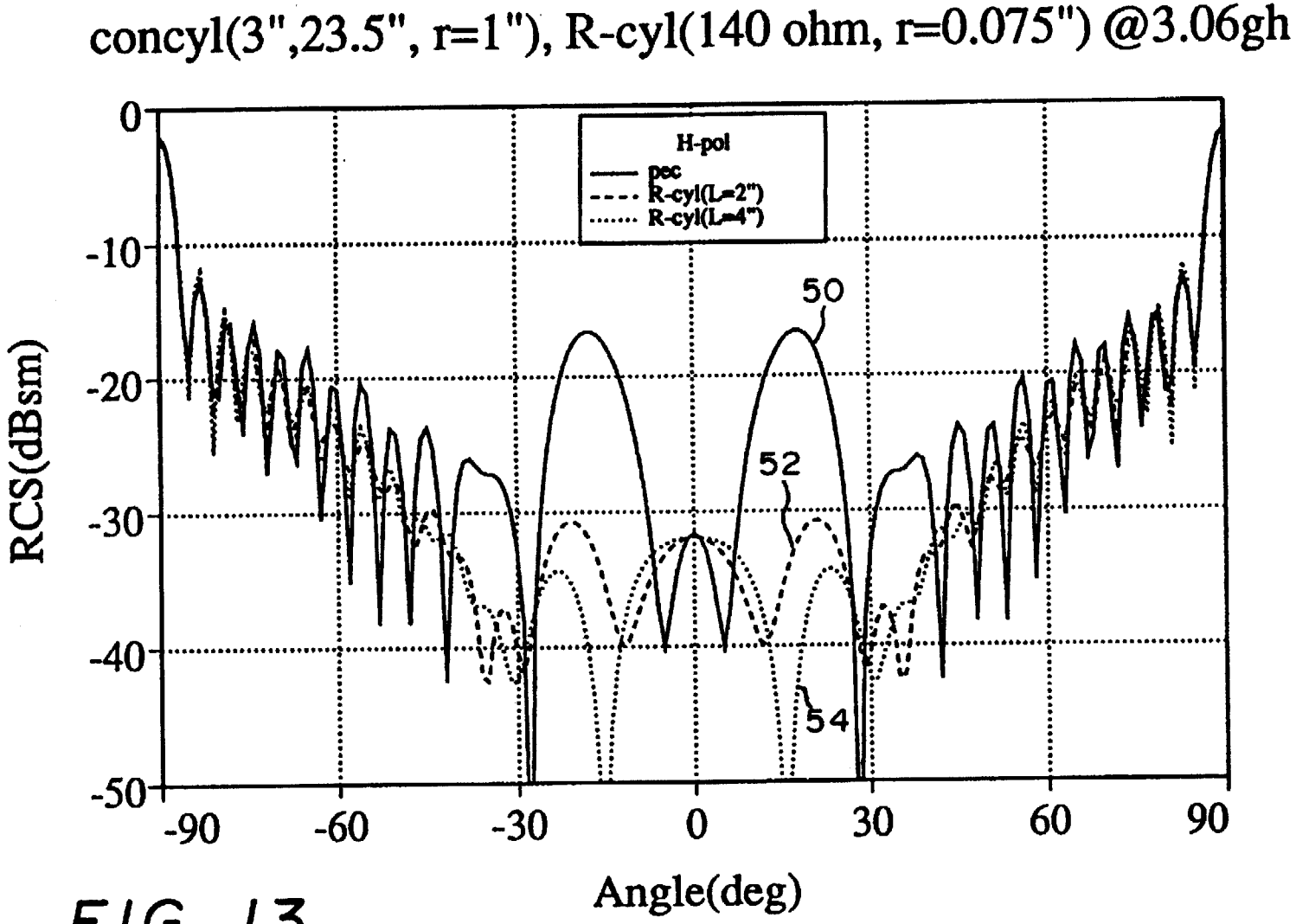
FIG. 13 is a graph of radar cross-section vs. azimuth angle, illustrating the effectiveness of the resistive element from FIG. 12, using calculations based on numerical methods of electromagnetic theory.

The radar cross-section (RCS) obtained by computation is illustrated in FIG. 13. In this method of computation, the surface current distribution is obtained by employing a method of numerical solution to Maxwell's equations. The RCS is then computed from this surface current distribution. (It is noted that this method for computing RCS is well known in the field as "the method of moments".) The angle, 0°, is the incident angle at the "nose-on" position. Curve 50 represents the RCS from a perfectly conducting body, without the apparatus 22 connected thereto. The traveling wave lobe is between −30° and +30°. The peaks of the traveling wave lobe are at about ±20°. This angle can be predicted by Equation 1, found in the Background of the Invention. A second curve 52 illustrates the RCS from the body with an apparatus 22 having a length of 2" and surface resistance of 140 Ω per square. In this embodiment, it is clearly seen that the traveling wave lobe is significantly reduced from the body without the apparatus 22. Curve 54 illustrates the use of a 4" tubular resistive element 22. This curve shows how the traveling wave lobe can be further reduced by an increase in length of the apparatus 22. Although curves 52 and 54 are measured at the same frequency, the fact that different lengths of the apparatus 22 can significantly reduce RCS implies the robustness of this apparatus for wideband traveling wave scattering reduction.

Figure 14:
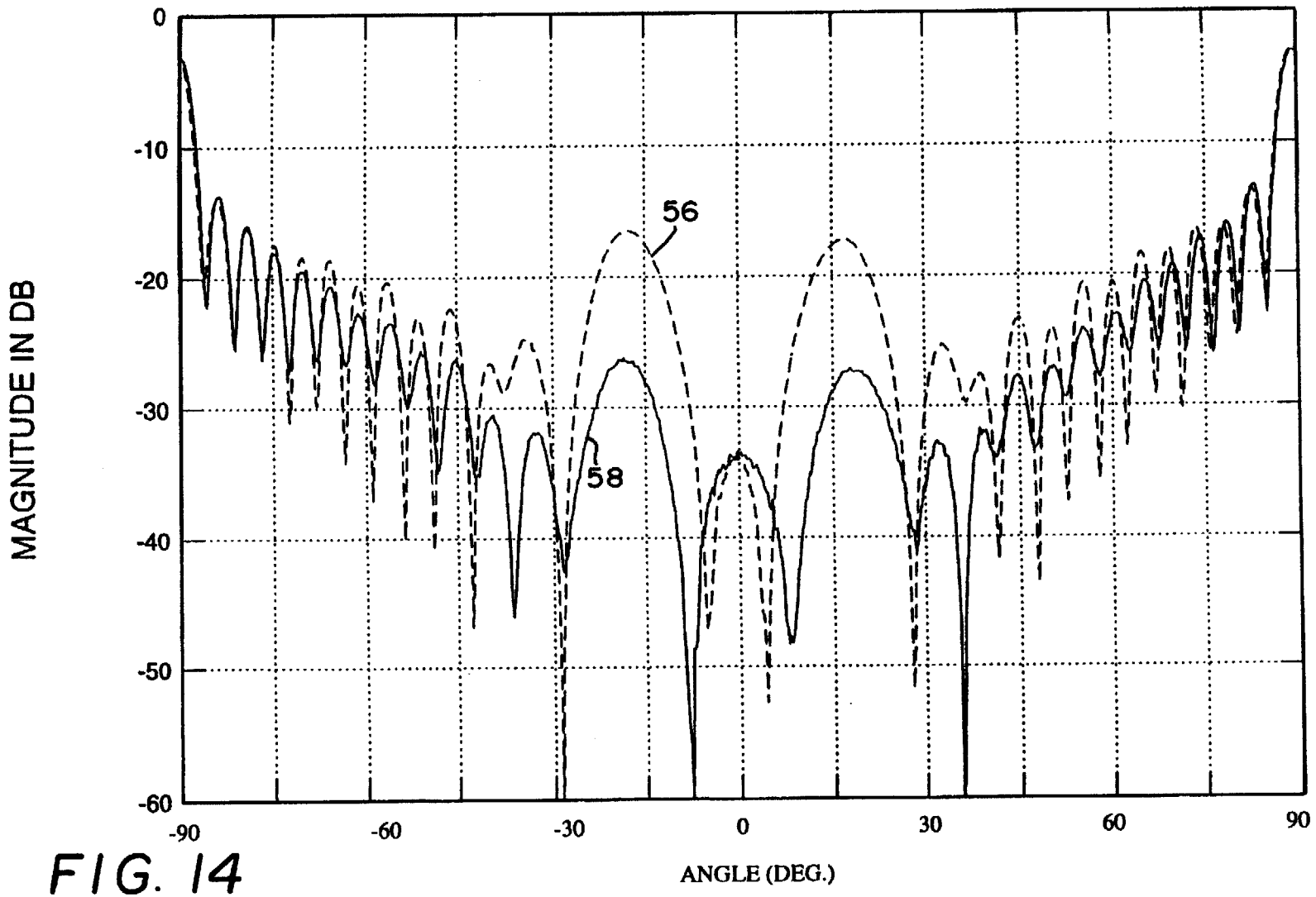
FIG. 14 is a graph of radar cross-section vs. angle, from actual measurements of a 2" tubular resistive element, in accordance with the FIG. 12 embodiment.

To verify the predictions of FIG. 13, a model of the scattering body 40 was constructed and RCS measured. Referring to FIG. 14, curve 56 illustrates measurements taken from the body in accordance with the dimensions shown in FIG. 12. In this instance, the apparatus 22 is not attached. In curve 58, the apparatus 22 is attached, in the form of a 2" tube. The reduction in the RCS level is, again, significant, as was predicted.

Figure 15:
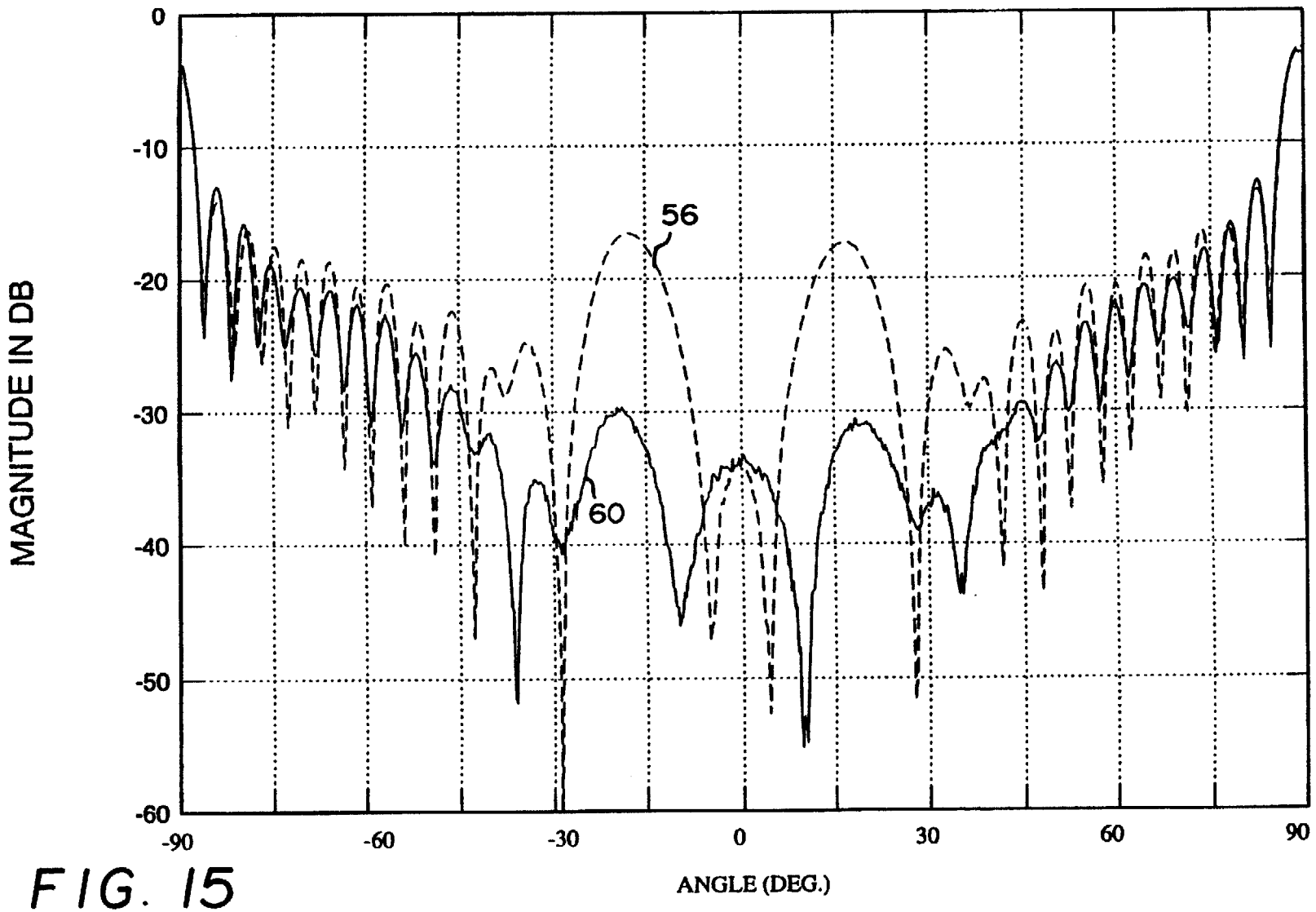
FIG. 15 is a graph of radar cross-section vs. angle, for a 4" tube.

FIG. 15 shows the measured results from the use of a 4" tube. As can be seen from this Figure, the RCS is even more significantly reduced when the tube length is increased, as shown by curve 60.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. A broadband apparatus for attenuating traveling wave reflections from an electrically conductive surface due to an impedance mismatch between the electrically conductive surface and free space, comprising:

a resistively graded element, comprising:

a forward end with an impedance approaching the impedance of the electrically conductive surface, said forward end being positionable relative to the electrically conductive surface so as to minimize the impedance mismatch between said forward end and free space; and an aft end with a high impedance relative to free space, said aft end being positionable sufficiently distant from said surface so as to minimize any traveling wave reflection due to an impedance mismatch between the electrically conductive surface and free space, wherein said resistively graded element comprises dielectric material coated with resistive material.

2. The apparatus of claim 1, wherein said resistively graded element comprises a tubular member.

3. The apparatus of claim 2, wherein said tubular member has a hollow interior.

4. The apparatus of claim 3, wherein said tubular member is formed of dielectric material with a dielectric constant in a range of about 2 to 5.

5. The apparatus of claim 1, wherein said resistive element is formed of resin-impregnated fiberglass fabric.

6. The apparatus of claim 5, wherein said resistive element further comprises a conductive polymer coating formed on said resin-impregnated fiberglass fabric.

7. The apparatus of claim 1, wherein said resistive element is formed of resin-impregnated quartz fabric.

8. The apparatus of claim 7, wherein said resistive element further comprises a conductive polymer coating formed on said resin-impregnated quartz fabric.

9. The apparatus of claim 1, wherein said resistive element is formed of Kapton™ material having resistive patterns formed thereon.

10. The apparatus of claim 9, wherein said resistive patterns formed thereon comprise a uniform impedance.

11. A system for attenuating traveling wave reflections from a body having an electrically conductive surface thereon, said traveling wave reflections being due to an impedance mismatch between the electrically conductive surface and free space, said system comprising:

a) a radar absorbing material applied to the electrically conductive surface of the body; and b) a resistive element, having an impedance between that of the electrically conductive surface and free space, positionable relative to the electrically conductive surface so as to .minimize an impedance mismatch between the electrically conductive surface and free space, wherein said resistive element comprises an elongated member formed of dielectric material coated with resistive material.

12. The system of claim 11, further including means for mechanically attaching said resistive element to the electrically conductive surface.

13. The system of claim 11, wherein said resistive element is positioned at the aft end of the body.

14. The system of claim 11, wherein said resistive element is positioned at a forward end of the body.

* * * * *